United States Patent [19]

Sato et al.

[11] 4,384,525

[45] May 24, 1983

[54] CODE PLATE DEVICE FOR LABEL PRINTING AND APPLYING MACHINES OR THE LIKE

[75] Inventors: Yo Sato, Tokyo; Fumio Goto; Tadao Kashiwaba, both of Kitagami, all of Japan

[73] Assignee: Kabushiki Kaisha Sato, Japan

[21] Appl. No.: 296,908

[22] Filed: Aug. 27, 1981

[30] Foreign Application Priority Data

Sep. 5, 1980 [JP] Japan ..... 55-125528[U]

[51] Int. Cl.[3] ..... B41K 1/12; B41K 1/56

[52] U.S. Cl. ..... 101/288; 101/405; 101/368; 16/112; 16/123

[58] Field of Search ..... 101/288, 291, 292, 324, 101/348, 368, 405, 406; 16/112, 121, 123

[56] References Cited

U.S. PATENT DOCUMENTS

| | | | |
|---|---|---|---|
| 1,431,842 | 10/1922 | Raush | 101/405 |
| 1,672,226 | 6/1928 | Mitchell et al. | 16/123 |
| 2,899,895 | 8/1959 | Tannery | 101/405 |
| 3,490,365 | 1/1970 | Roche | 101/292 |
| 3,762,317 | 10/1973 | Hamisch, Sr. | 101/288 |
| 4,044,677 | 8/1977 | Hamisch, Jr. | 101/348 |
| 4,095,711 | 6/1978 | Conley | 16/112 |
| 4,144,809 | 3/1979 | Sato | 101/288 |
| 4,154,166 | 5/1979 | Knott et al. | 101/291 |
| 4,164,182 | 8/1979 | Sato | 101/324 |
| 4,180,179 | 12/1979 | Raasch et al. | 101/368 |

FOREIGN PATENT DOCUMENTS

| | | | |
|---|---|---|---|
| 1069562 | 6/1954 | France | 101/405 |
| 270277 | 8/1950 | Switzerland | 101/405 |

*Primary Examiner*—William Pieprz

*Attorney, Agent, or Firm*—Ostrolenk, Faber, Gerb & Soffen

[57] ABSTRACT

The disclosure concerns a code plate device for a label printing and applying machine having a platen, a fixed hand grip, a hinged hand lever opposable to the hand grip, and a printing device carried on a printing lever extending from the hand lever so that the printing device is brought into and out of engagement with the platen, respectively, when the hand lever is squeezed and released. The code plate device includes a body having a guiding dovetail element which is removably fitted into a dovetail shaped engagement groove on the printing lever so that the code plate device can be detachably slid into attachment with the printing lever. The dovetail connection is oriented so that the code plate device is slid into position laterally of the machine. There is a foldable knob which is hingedly attached to the code plate body so that it can be extended straight for being grasped to enable attachment or detachment of the code plate device or can be folded up for moving the knob out of the way.

16 Claims, 6 Drawing Figures

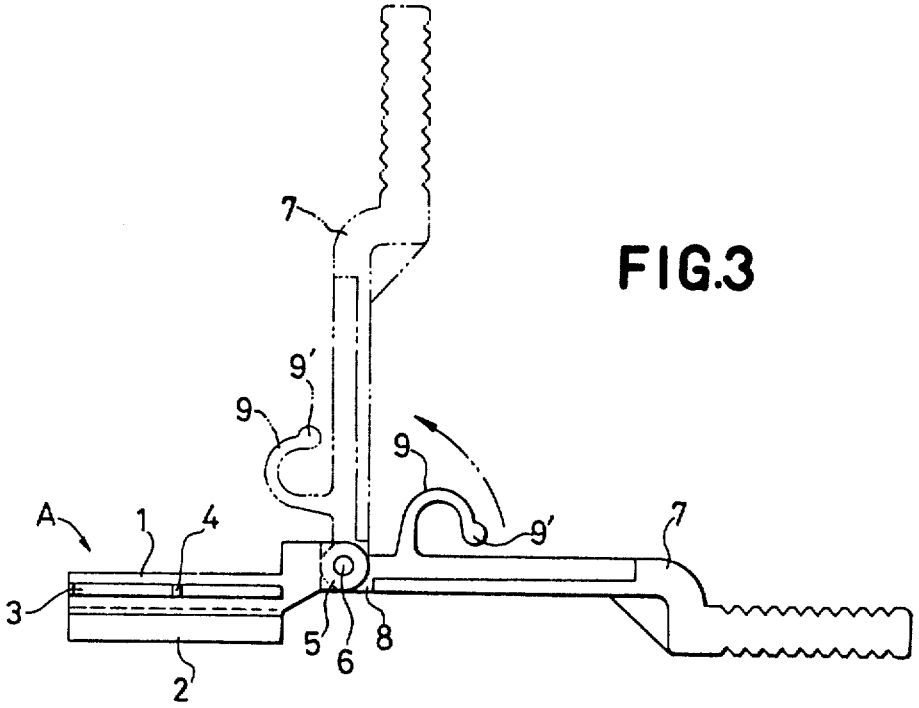
FIG.3
FIG.4
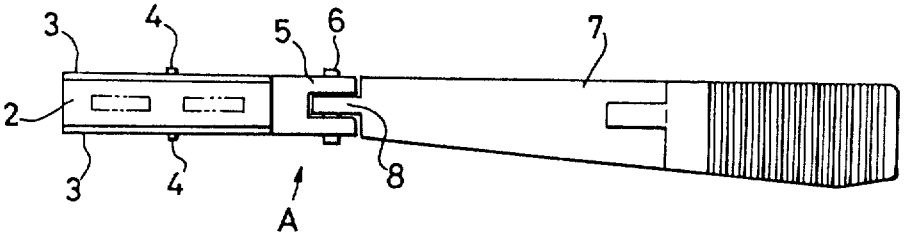

CODE PLATE DEVICE FOR LABEL PRINTING AND APPLYING MACHINES OR THE LIKE

BACKGROUND OF THE INVENTION

1. Field of the Invention

The present invention relates to a label printing and applying machine, and more particularly to a code plate device which is attached to the machine so as to add information to that provided by the printing device of the machine.

2. Description of the Prior Art

One embodiment of prior art code plate device includes a space formed at the back of the printing device, through which a code plate can be attached to or detached from the printing head by manually pinching a leaf spring which acts as the knob of the device. In another embodiment there is attached to the back of the printing device a case body, and a code plate is transversely slid into or out of engagement with the case body.

However, with the first embodiment, the fingers of the operator of the machine may touch the ink roller or rollers of the printing device and be dirtied with ink. In addition, the attachment or detachment of the code plate itself is troublesome. With the other embodiment, on the other hand, the code plate cannot be directly attached to the label printing and applying machine whereby the case body becomes indispensable, and retaining means having a complex construction, such as a heart-shaped cam groove, is required for retaining that code plate. As a result, the code plate device as a whole is so large-sized as to raise its production cost.

SUMMARY OF THE INVENTION

It is, therefore, an object of the present invention to provide a code plate device for use with a label printing and applying machine, which device is free of the disadvantages of the prior art.

Another object of the present invention is to provide a code plate device in which a code plate can be easily but reliably attached to or detached from the frame of a label printing and applying machine in a direct manner without the use of a case body so that the space of the machine can be efficiently used.

A code plate device according to the present invention is used with a label printing and applying machine that includes a fixed platen, a fixed hand grip, a hand lever hinged to and opposable to the hand grip such that the hand lever is usually biased apart from the hand grip but can be squeezed to the hand grip against a biasing force, a pair of printing levers extending from the hand lever, and a printing device carried on the printing levers to be brought into and out of engagement with the platen, respectively, when the hand lever is squeezed and released. The code plate device comprises a dovetail shaped engagement groove formed in the frame of the printing levers and a code plate body having a guide portion that is sized and positioned, i.e. dovetail shaped to be removably fitted in the engagement groove so that the code plate device can be detachably attached to the frame of the printing levers. A foldable knob member is hingedly attached to the code plate body so that it can be extended straight with respect to the code plate body and can be pinched to attach or detach the code plate device to or from the frame of said printing levers, and so that the knob member can be folded up out of the way.

BRIEF DESCRIPTION OF THE DRAWINGS

Other objects and features of the present invention will become apparent from the following description made with reference to the accompanying drawings, in which:

FIG. 3 is a side elevational view of the code plate device;

FIG. 4 is a bottom view thereof;

DESCRIPTION OF THE PREFERRED EMBODIMENT

A code plate device according to the present invention is constructed so that it is detachably attached to the crosspiece or frame 12 of the printing levers 11. The printing levers are molded integrally with the hand lever 21 of a label printing and applying machine.

Figure 1:
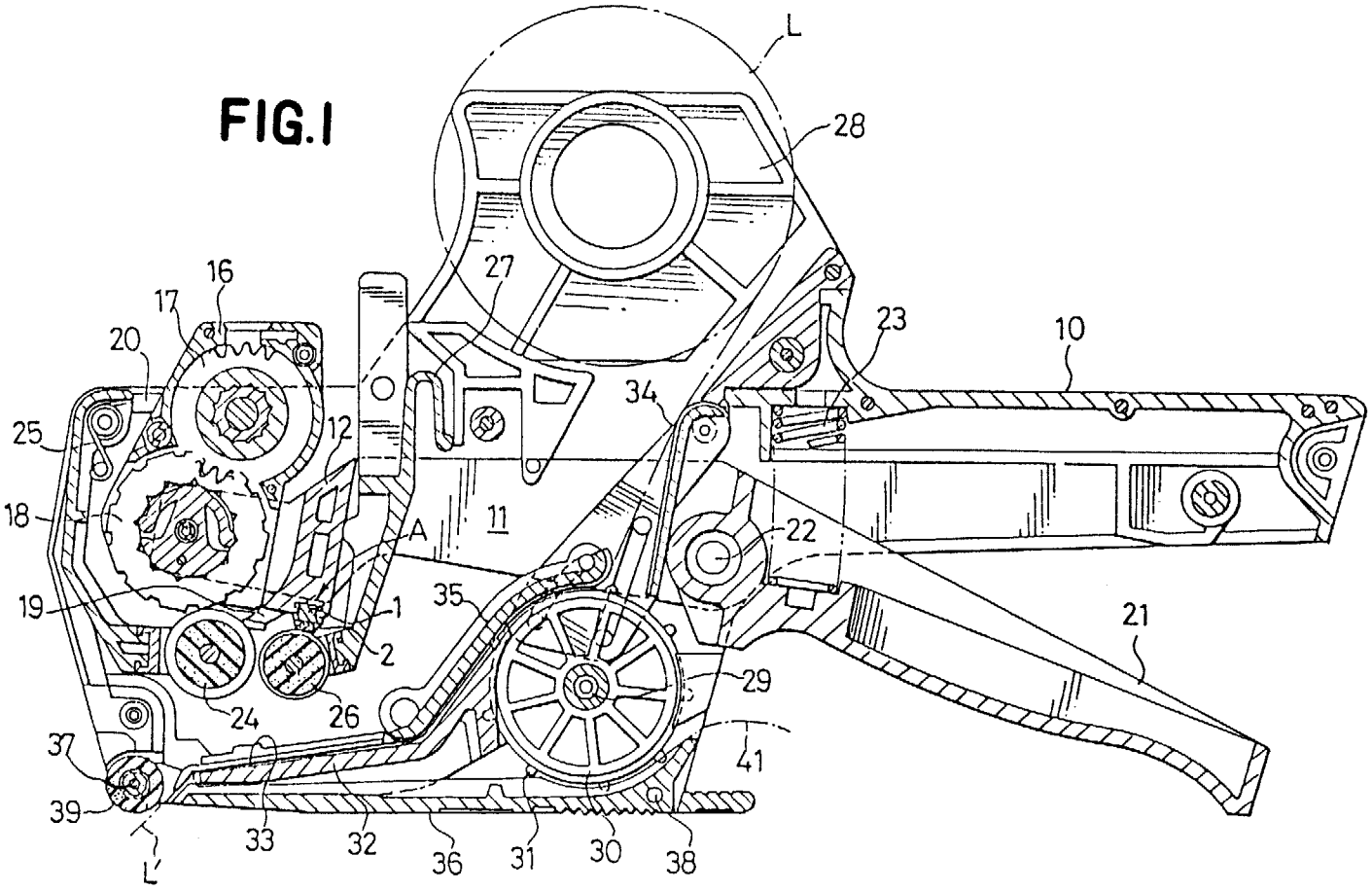
FIG. 1 is a side, elevational, sectional view of a label printing and applying machine which is equipped with a code plate device according to the present invention.
Figure 2:
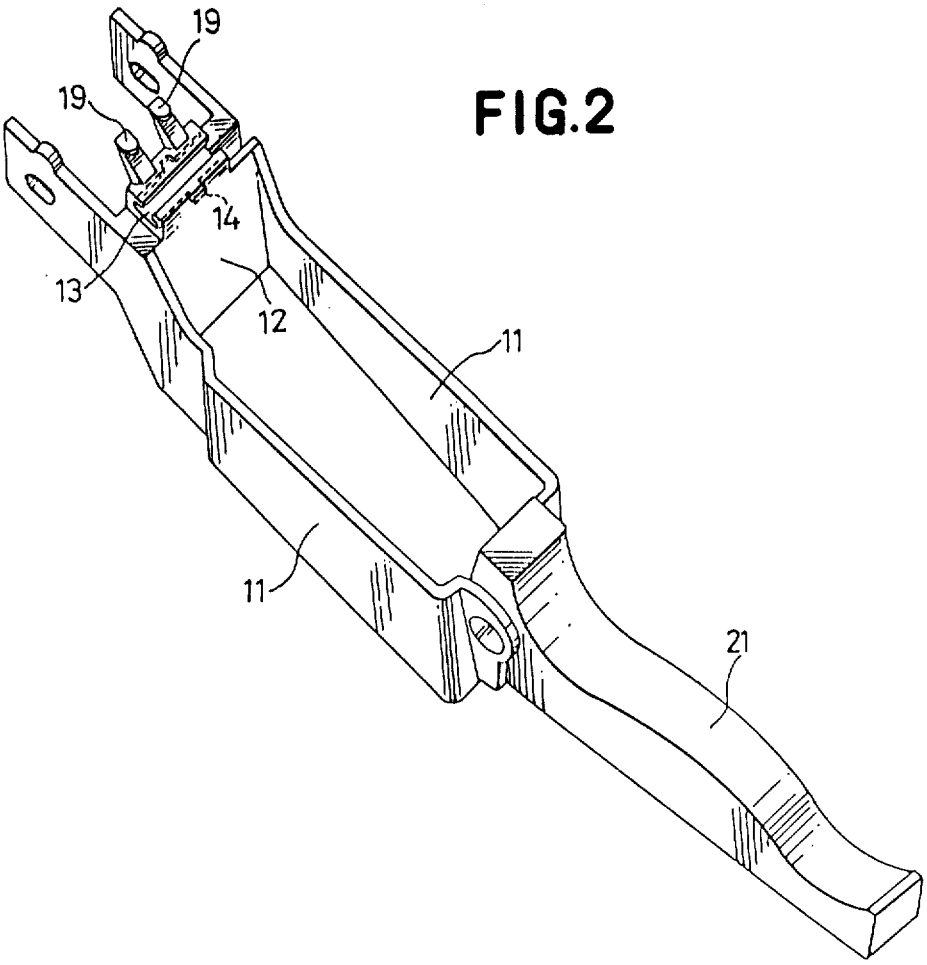
FIG. 2 is a bottom perspective view of a pair of printing levers, and showing the attaching portion of the code plate device of the present invention.

A machine equipped with the code plate device A is described with reference to FIGS. 1 and 2. It includes a hand grip 10 which is held between a pair of parallel, spaced apart machine frames 20 that are disposed at both sides of the machine. A hand lever 21 is hingedly supported between the machine frames 20 by a pivot pin 22. The hand lever is movable toward and away from the hand grip. A coil spring 23 is interposed under compression between the hand lever and the hand grip. The spring returns the hand lever 21 apart from the hand grip 10 when the hand lever is released after it has been squeezed toward the hand grip 10.

A pair of printing levers 11 extend bifurcated and parallel to each other forward from the front of the hand lever 21. A cross frame 12 extends between the printing levers 11.

There is a printing head 16 which is equipped with a toothed, type wheel 18, which bears types indicative of the price of an article. A toothed, type-selecting or indexing wheel 17 is in meshing engagement with the type wheel 18 for selecting the type on the type wheel 18. The printing head 16 is attached to the leading (left-hand) ends of the printing levers 11.

Frame 12 carries a pair of label correcting members 19, which are disposed below and adjacent to the back of the printing head 16, and press down upon upstanding feed flaps on a label strip being advanced through the machine. An engagement groove 13 behind the correcting members 19 is formed into a dovetail shape so as to provide a mount for the code plate device A. The code plate device A, the label correcting members 19 and the printing device 16 are positioned in a facing relationship toward the fixed platen 32 of the label printing and applying machine.

Figure 5:
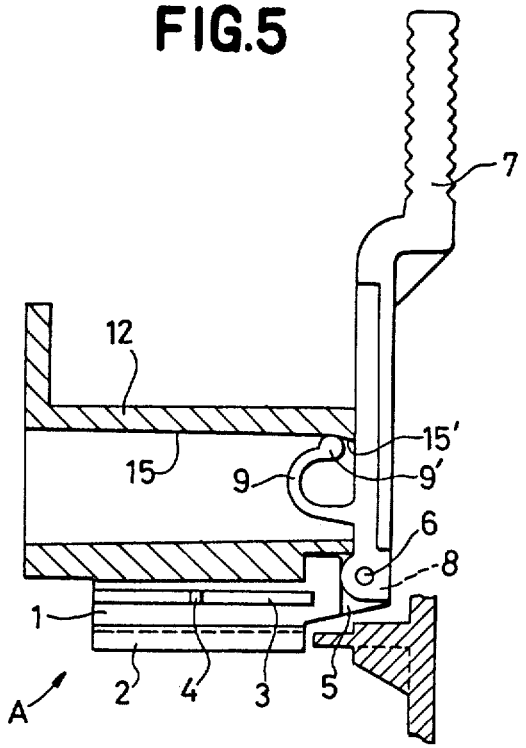
FIG. 5 is a longitudinal sectional view showing the attached state thereof.

Referring to FIGS. 3 to 5, the code plate device A includes a code plate body 1 and a foldable or pivotable knob member 7. The bottom surface of the code plate body 1 carries a letter or character portion 2 which is composed of special letters indicating the name of a store, a bargain-priced or specially priced article, or the like. The code plate body 1 is formed with a dovetail shaped guide portion 3, with side panels which protrude from both sides of the code plate body, and the guide portion is shaped and sized such that it can be removably slid along and fitted in the dovetail shaped engagement groove 13 formed in the frame 12 of the printing levers 11. Both of the projecting side panels of the dovetail shaped guide portion 3 are formed generally at their longitudinal centers with engagement projections 4. These engagement projections 4 are retained in recesses 14, which are formed in the walls of the engagement groove 13, thereby to retain the code plate body 1 to the printing levers. The code plate body 1 has a bifurcated base portion 5. Between the arms of the base portion 5 is received the base portion 8 of the knob member 7. Both portions 5 and 8 are hinged to each other by a pivot pin 6 which enables the knob member 7 to be pivoted and folded. The knob member 7 has a folded side, which is the side that is nearer to the body 1 when the knob is folded. The folded side is integrally formed with a projecting, elastic retaining portion 9, which is generally "U" shaped. The U projects with its web end outward. The retaining portion has the leg thereof that is nearer the pivot pin 6 attached to the code plate, while the leg farther away is detached. The farther leg engages the below described retaining groove 15. The device A is attached by transversely inserting and sliding the dovetail shaped guide portion 3 into the dovetail engagement groove 13 in the frame of the printing levers, while the code plate body 1 and the knob member 7 are extended in a straight line, until the engagement projections 4 are retained in the recesses 14 of the groove 13.

Then the knob member 7 can be folded into an "L" shape, as shown in FIG. 5, with respect to the code plate body 1 by being turned in the direction indicated by a double-dotted arrow in FIG. 3. The detached leg of the elastic retaining portion 9 of the knob member 7 is brought into engagement with a retaining groove 15 formed in the frame 12, so that the knob member 7 can be retained in its folded condition. The retaining groove 15 has an insertion inlet that is gradually reduced into a tapered portion 15', on which the round leading end 9' of the elastic retaining portion 9 can be reliably retained, when it is inserted into engagement. Thus, the knob member 7 is prevented from falling down even upon the impacts during the printing operation.

Returning to FIG. 1, the general construction of the otherwise conventional label printing and applying machine for containing the code plate device of the invention, is now further described. Two ink rollers 24 and 26, which are impregnated with different colors of ink, such as black and red ink, respectively, are supported to abut against the types of the type wheel 18 of the printing device 16 and the letter portion 2 of the aforementioned code plate body 1, respectively.

The base portion of the ink roller 24 is elastically biased by torsion spring 25 toward the type wheel 18, and the base portion of the ink roller 26 is elastically biased by elastic retaining portion 27, which is integrally molded of an elastic synthetic resin, toward the code plate body 1, 2.

A label holder 28, on which a composite, rolled up label tape or strip L is held, is disposed above the frame of the label printing and applying machine. At the bottom of the frames 20 of the machine, a spindle 29 is journaled between the machine frames 20. A feed wheel 30 is mounted on the spindle. Its outer circumference is formed with a plurality of equidistantly spaced apart pins 31.

Above the feed wheel 30, there are both a label guide member 34 and a label holding member 35 which partially covers the member 34. Both members 34 and 35 shift in response to the counterclockwise swinging motion of the platen 32, when the machine is to be charged with the composite label strip L, for easing insertion of the label strip and partly to bring the label strip L into engagement with the feed wheel 30 during the label feeding operation.

A bottom cover 36 is hinged beneath the bottom portion of the platen 32 by a pivot pin 37 such that the cover 36 is opened during the label charging operation, but is usually closed by a retaining lock pin 38 which is provided at the end of the bottom portion of the platen 32.

Figure 6:
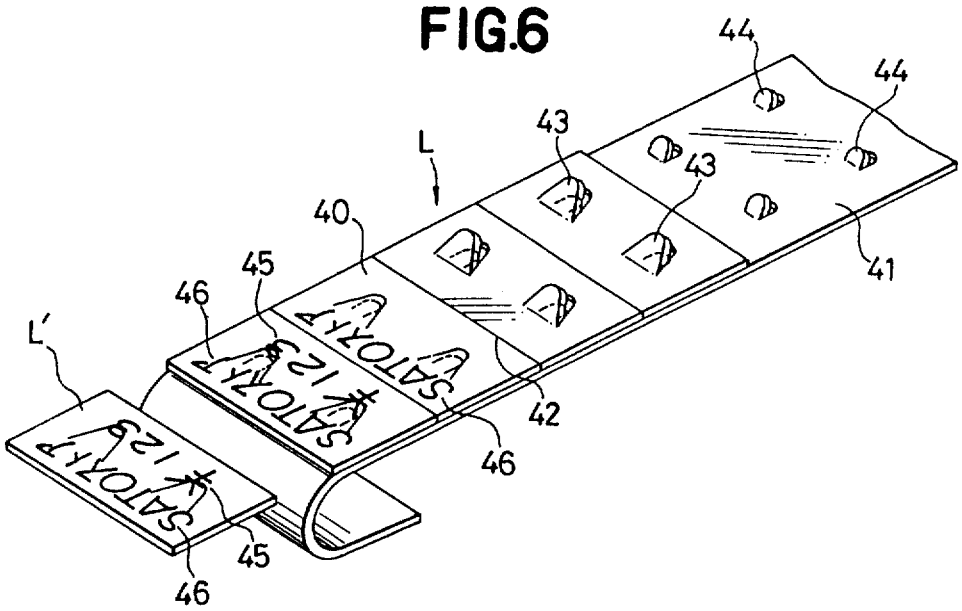
FIG. 6 is a perspective view showing a composite label strip to be imprinted by means of the code plate device.

The composite label strip L to be applied to the label printing and applying machine is composed, as shown in FIG. 6, of a number of individual labels 40 which are removably secured to the backing tape 14, and a parting agent is applied to the surface of the backing tape 41 while an adhesive is applied to the backs of the labels 40.

Those labels 40 are separated at longitudinally spaced intervals along the label strip L by a number of transverse cuts 42, whereby a number of printed labels L' may be peeled from the strip 41 so that they may be applied to articles to be labeled. Each label 40 has a pair of feed flaps 43 generally having the shape of a letter "V". That area of the backing tape 41, which backs each label 40, is formed with a pair of feed flaps 44 which generally have a "U" shape and which are positioned respectively to underlie the paired feed flaps 43 in an overlapping manner.

The feed flaps 43 and 44 of the labels 40 and the backing tape 41 are engaged with the feed pins 31 of the feed wheel 30. The wheel 30 is intermittently rotated in response to the release of the hand lever 21 after it has been squeezed, so that the composite label strip L is advanced toward the platen 32.

The composite label strip L thus fed out onto the printing surface 33 of the platen 32 has its individual labels 40 imprinted with both price characters 45 and other identifying characters 46 after the printing device 16 and the code plate device A have been lowered to the platen 32 during the squeezing of the hand lever 21 and after the black and red inks have been applied to the printing device 16 and the letter portion 2 of the code plate body 1 of the present device A, respectively, by means of the ink rollers 24 and 26.

Before or upstream of that printing step, the feed flaps 43 and 44 formed in the composite label tape L are engaged by the feed wheel 30,31 so that the flaps stand up while the label strip L is being fed onto the platen 32. However, those feed flaps 43 and 44 are flattened at the label correcting step by the pushing action of the label correcting member 19 which is disposed adjacent to the code plate device A.

During subsequent releasing of the hand lever 21 after it has been squeezed, the labels 40 which were temporarily adhered to the backing tape 41 are peeled one by one as printed labels L' from the backing tape 41 through the cooperation of the advancing action of the composite label strip L and the tensioning of the backing tape 41 which has been turned rearwardly in the vicinity of the leading end of the platen 32 to form a small loop. The rearwardly directed backing strip again engages the feed pins 31 at the underside of the feed wheel 30. The printed labels L' are applied one-by-one to other articles by an applying roller 39 which is rotatably mounted on the pivot pin 37 at the leading end of the machine.

Since the frame of the printing levers, which are integral with the hand lever, has an engagement groove that enables the code plate body having the dovetail shaped guide portion to be detachably attached to the frame of the printing levers, the code plate body can be directly attached to the label printing and applying machine efficiently, using the available space. Moreover, since the foldable knob member is attached to the code plate body, it can be extended straight for handling, when the code plate device is to be attached or detached, which eases these operations.

Because the code plate device has its foldable knob member formed with an elastic retaining portion, which is retained in the retaining groove formed in the frame of the printing levers, it has the additional advantage that the knob member is not returned from its L-shaped folded position to its straight position even by the impact during a printing operation.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A code plate device for a label printing and applying machine, wherein the machine includes:

a platen on which a label is to be printed, a printing lever, a printing device supported on the printing lever end being for imprinting characters on a label that is positioned on the platen; means for advancing labels across the platen; means for moving the platen and printing lever with respect to each other for imprinting a label then on the platent with the imprint of the characters on the printing device;

first engaging means on the printing lever for engaging the code plate device;

the code plate device comprising;

a code plate body having a guide portion for being removably engaged with the first engaging means; means supported on the code plate body for also imprinting characters on a label positioned on the platen;

a knob member connected to the code plate body at a hinged connection and being foldable by pivoting at the hinged connection with respect thereto, between a folded condition where the knob member extends generally more along a side of the machine, and an extended condition, where the knob member projects out of the side of the machine in a direction more across the side of the machine for easing grasping of the knob member for facilitating insertion and removal of the code plate device with respect to the printing lever;

retaining means for retaining the knob member at the folded condition thereof; the retaining means comprises an elastic retainer on the knob member and comprises a surface of the printing lever which is adapted for engaging the retainer and for retaining such engaged condition between the retainer and the surface.

2. The code plate device of claim 1, wherein the first engaging means and the guide portion are respectively shaped and oriented to enable extraction and insertion of the code plate body with respect to the printing lever in a direction across the side of the machine.

3. The code plate device of claim 2, wherein one among the first engaging means and the guide portion comprises a groove and the other among the first engaging means and the guide portion comprises an element adapted for being slid into the groove for insertion of the code plate body in the engaging means of the printing lever.

4. The code plate device of claim 2, further comprising retaining means for retaining the knob member at the folded condition thereof.

5. The code plate device of claim 2, wherein the first engaging means comprises a groove and the guide portion on the code plate body includes an element adapted for being slid into the groove for insertion of the code plate body in the engaging means of the printing lever.

6. The code plate device of claim 5, wherein the groove and the element are of complementary dovetail shapes.

7. The code plate device of any of claims 3, 5 or 6, further comprising means for retaining the element at its inserted position in the groove.

8. The code plate device of claim 7, wherein the means for retaining the element in the groove comprises a recess in the wall of the groove and a projection on the element which is engageable in the groove wall recess.

9. The code plate device of claim 1, wherein the first engaging means and the guide portion are respectively shaped and oriented to enable extraction and insertion of the code plate body with respect to the printing lever in a direction across the side of the machine.

10. The code plate device of claim 1, wherein the surface on the printing lever includes a groove into which the retainer is moved and in which the retainer is retained.

11. The code plate device of claim 1, wherein the surface includes a retainer insertion inlet at which the retainer first passes into engagement with the surface, and the insertion inlet being shaped for defining a surface that is tapered for retaining the retainer against moving out of engagement with the surface through the retainer insertion inlet, thereby for retaining the knob member from moving from the folded to the extended conditions thereof.

12. A code plate device for a label printing and applying machine, wherein the machine includes:

a platen on which a label is to be printed, a printing lever, a printing device supported on the printing lever end being for imprinting characters on a label that is positioned on the platen; means for advancing labels across the platen; means for moving the platen and printing lever with respect to each other for imprinting a label then on the platen with the imprint of the characters on the printing device;

first engaging means on the printing lever for engaging the code plate device;

the code plate device comprising:

a code plate body having a guide portion for being removably engaged with the first engaging means; means supported on the code plate body for also imprinting characters on a label positioned on the platen;

a knob member connected to the code plate body and being foldable with respect thereto, between a folded condition where the knob member extends generally more along a side of the machine, and an extended condition, where the knob member projects out of the side of the machine in a direction more across the side of the machine for easing grasping of the knob member for facilitating insertion and removal of the code plate device with respect to the printing lever;

retaining means for retaining the knob member at the folded condition thereof; the retaining means comprises an elastic retainer on the knob member and comprises a surface of the printing lever which is adapted for engaging the retainer and for retaining such engaged condition between the retainer and the surface;

the retainer is generally U-shaped and projects, web end of the U first, out from the code plate body, the retainer being oriented so that one leg of the U thereof is further from the fold than the other leg and the one leg is the leg which engages the surface on the printing lever.

13. The code plate device of claim 12, wherein the one leg is detached from the code plate body and the other leg is attached to the code plate body.

14. The code plate device of claim 13, wherein the surface includes a retainer insertion inlet at which the retainer first passes into engagement with the surface, and the insertion inlet being shaped for defining a surface that is tapered for retaining the retainer against moving out of engagement with the surface through the retainer insertion inlet, thereby for retaining the knob member from moving from the folded to the extended conditions thereof.

15. The code plate device of claim 12, wherein the surface includes a retainer insertion inlet at which the retainer first passes into engagement with the surface, and the insertion inlet being shaped for defining a surface that is tapered for retaining the retainer against moving out of engagement with the surface through the retainer insertion inlet, thereby for retaining the knob member from moving from the folded to the extended conditions thereof.

16. The code plate device of claim 15, wherein the surface on the printing lever includes a groove into which the retainer is moved and in which the retainer is retained.

* * * * *